United States Patent [19]

Moore et al.

[11] 4,428,658

[45] Jan. 31, 1984

[54] COMBINED FILM CASSETTE UNLOADING AND FILM PROCESSING DEVICE

[75] Inventors: Michael H. Moore, Ilford; George F. A. M. Turner, both of Ingatestone, England

[73] Assignee: Ciba-Geigy AG, Basel, Switzerland

[21] Appl. No.: 438,812

[22] Filed: Nov. 3, 1982

[30] Foreign Application Priority Data

Nov. 4, 1981 [GB] United Kingdom ..... 8133194

[51] Int. Cl.[3] ..... G03D 13/06

[52] U.S. Cl. ..... 354/310; 354/313

[58] Field of Search ..... 354/307, 308, 312, 313, 354/314, 316, 323, 310

[56] References Cited

U.S. PATENT DOCUMENTS

| | | | |
|---|---|---|---|
| 2,194,603 | 3/1940 | Lingg et al. | 354/310 |
| 2,290,152 | 7/1942 | Andrews et al. | 354/310 |
| 3,703,859 | 11/1972 | Katsuragi | 354/310 |
| 3,906,966 | 9/1975 | Drake et al. | 354/314 X |

FOREIGN PATENT DOCUMENTS

| | | |
|---|---|---|
| 671170 | 4/1952 | United Kingdom . |
| 1589379 | 5/1981 | United Kingdom . |

*Primary Examiner*—A. A. Mathews
*Attorney, Agent, or Firm*—Harry Falber

[57] ABSTRACT

A film cassette unloading and film processing device comprises a light-sealable container having means to hold a film cassette in such a manner that a length of film can be withdrawn therefrom, together with a film cutting means. A lid member of a processing tank of the film-holding spiral type, is rotatably but detachably mounted in a light-tight manner in one side of the container, the spiral being attached to the lid member and so located in the container that the film from a cassette can be wound thereon. On the opposite side of the container there is located a tank-completing base member which, together with the lid member and the spiral, forms a processing tank of the film-holding spiral type. The base member is so held in a light-tight manner that, when the film from the cassette has been wound onto the spiral and its end cut free from the cassette, the base member can be fitted on to the lid member and the tank can be completed while both members are connected to the light-tight container, whereupon the processing tank can be removed from the container as a unit once it has been assembled.

5 Claims, 3 Drawing Figures

COMBINED FILM CASSETTE UNLOADING AND FILM PROCESSING DEVICE

BACKGROUND OF THE INVENTION

This invention relates to a combined film cassette unloading and film processing device, in which a light-tight closable container comprises, in its interior, means for holding a film cassette in such a manner that a piece of film of determined length can be withdrawn therefrom, as well as film cutting means for cutting off the withdrawn piece of film.

In recent years there has been a considerable increase in the home processing and printing of photographic films. But at the same time it is becoming increasingly difficult and inconvenient for people who wish to process and print their own films to find in their home a suitable room which can be blacked out and used as dark room. In particular when a normal spiral processing tank is loaded with exposed photographic film straight from a cassette this operation is required to be carried out in the virtual absence of all visible light.

A number of prior art daylight loading processing tanks have been described in the patent literature but few have been actually used because of their expense, complexity and bulkiness. For example in U.S. Pat. No. 2,290,152 there is described a complex spiral daylight loading processing tank which comprises an auxiliary chamber in which a film cassette is received. This is a bulky tank and would be difficult to load with the film. A similar complex and bulky device is described in British patent specification No. 671,170. A more elegant solution to the problem is described in U.S. Pat. No. 3,906,966 wherein a cassette is unloaded onto a spiral which is present in a shallow processing dish, and not in a tank. Processing would not be uniform in such a shallow dish as it could be very difficult to wet the film uniformly as well as to provide the correct type of agitation. An even more complex solution to the problem is described in the published French patent application No. 2,369,597 wherein the film is loaded in daylight onto a spindle which is extended out of a receiver. The spindle can then be retracted into the body of the receiver. To process the film the receiver is associated with a processing container and the spindle carrying the film is extended into the processing container. The film is then unwound into the processing liquid and wound up again.

OBJECTS AND SUMMARY OF THE INVENTION

It is an object of the present invention to provide a device of the initially described type which enables a normal spiral daylight processing tank to be loaded in daylight, i.e. without requirement of a dark room, with an exposed film or the like photographic material.

These objects are attained in accordance with the invention by providing a film cassette unloading and film processing device of the initially described type which comprises a lid member of a processing tank of the film-holding spiral type being rotatably but detachably mounted in a light-tight manner in one side of the container, a spiral being attached to the inner side of the said lid member and so located in the container that the film from a cassette can be wound thereon, and a tank-completing base member located on the opposite side of the container which base member together with the lid and the spiral form a processing tank of the spiral film-holding type, the base member being so held in a light-tight manner that when the film from the cassette has been wound onto the spiral and when the end of said film piece has been cut off from the cassette, the base member can be fitted on to said lid member whilst both are still connected to the container in a light-tight manner, whereupon the completed processing tank can be removed as a unit from the container as an entity once it has been assembled.

Preferably the lid member is held in the side of the container by a rotating seal.

In one embodiment of the device according to the invention, the tank-completing base member is also held in the side of the container by a rotating seal so that it can be slid towards the lid member by rotation, caused by a rotatable closure means, to make connection with the lid member after the film has been wound onto the spiral.

In another embodiment of the device according to the invention, the base member is held loosely in a light-tight bag attached to the container on the side of the latter opposite to the side thereof holding the lid member; the base member can be placed in contact with the lid member by manipulation on the outside of the bag.

The base member can be mated to the lid member by any of the well known means to assemble a processing tank, for example to form an interference fit, or by a screw connection or bayonet connection.

The spiral may be of the internal winding type, or of the external winding type as long as a face wheel mechanism is present in this latter case to enable film to be wound thereon by an oscillating movement.

The processing tank preferably is of the top filling type, that is to say, processing liquid or wash water may be fed into the tank and liquid may be removed from the tank by inverting the tank. However the tank may be of the dunking type, that is to say, there may be present, in the lid of the tank and in the floor of the base member of the tank, liquid-permeable but light-tightly closed holes. When a tank of this nature is placed in a processing solution liquid the latter enters the tank through the holes in its base. When the tank is removed from the processing liquid the liquid flows out of the bottom openings of the tank.

BRIEF DESCRIPTION OF THE DRAWINGS

Further details and advantages of the device according to the invention will be seen from the further description thereof in connection with the accompanying drawings which serve to illustrate a preferred embodiment of the device of the present invention. In the drawings.

In all the figures, like reference numbers designate like parts.

DETAILED DESCRIPTION OF THE EMBODIMENT SHOWN IN THE DRAWINGS

Figure 1:
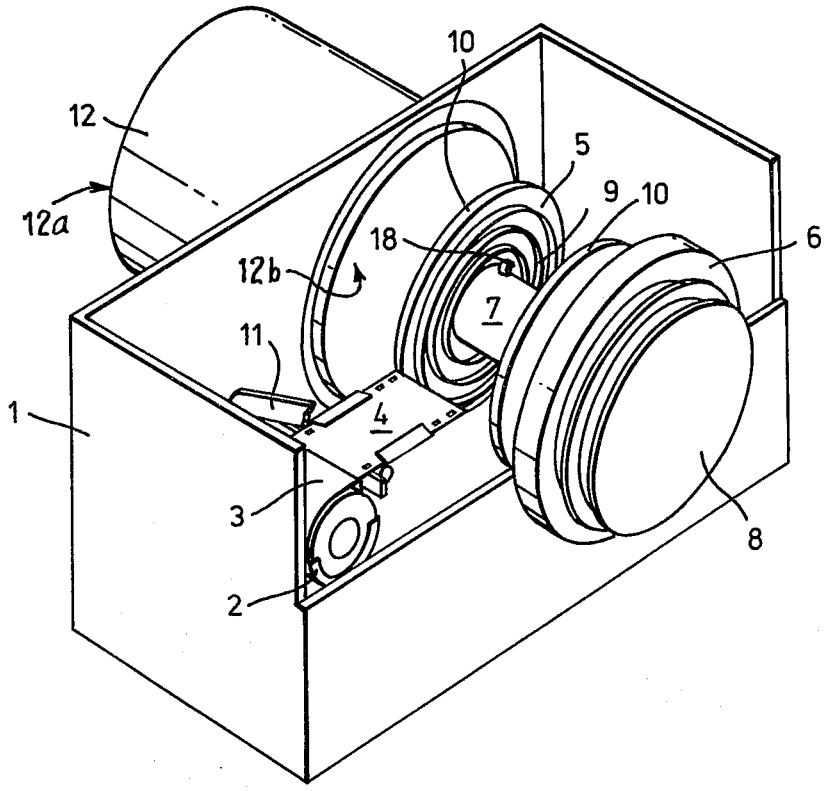
FIG. 1 is a perspective view of the device with the container lid member removed.

As shown in FIG. 1, a light-tight container 1 comprises holding means 2 for holding a cassette 3. A length of film 4 is shown as withdrawn from the cassette and being wound onto a spiral 5 which is attached to lid 6 of a processing tank which further comprises a sidewall and a closed bottom wall. This spiral 5 comprises a central shaft 7 to which are attached two discs 10 each of which comprises a helically wound continuous spiral wire 9. The length of film 4 passes between a preferably guillotine-type cutter means 11. On the lid 6 there is fitted the lid cap 8 from the outside.

Held in the wall of the container 1 opposite the lid 6 there is light-tightly connected at its open end 12*b* a tank-completing base member 12 comprising a closed bottom 12*a* and a preferably cylindrical sidewall of the processing tank.

Figure 2:
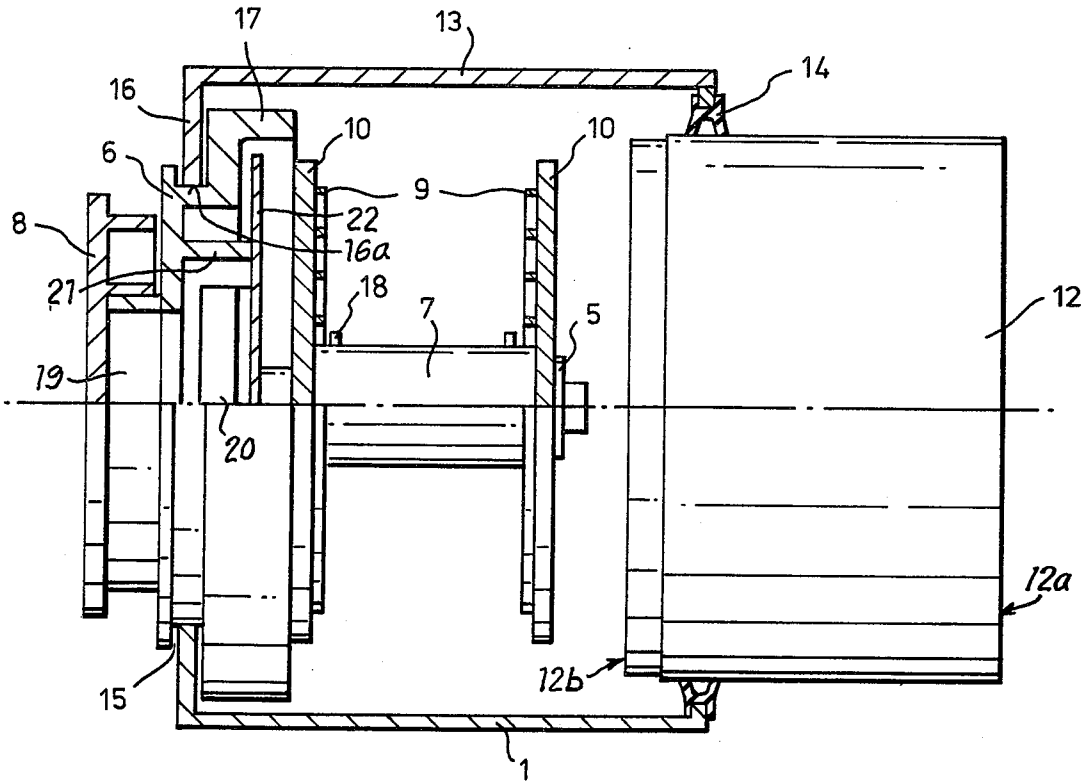
FIG. 2 is a side view of the device, partially in axial section.

In FIG. 2 there is shown the location of the tank-completing base member 12 in one of the sidewalls of the container 1 with relation to the spiral 5 and the lid 6 prior to winding of an exposed film strip on to the spiral 5 of the device is closed in this case by a upper part 13 of the container casing. The base member 12 is held rotatably or axially displaceably, but in a light-tight manner, in that sidewall of the container 1 which is opposite the lid 6, by means of a circumferential double seal 14.

At the circumference of the lid 6, there is provided an annular groove 15 which is engaged by rim elements surrounding an opening provided in the sidewall 16 and in the upper closure member 13 of the container 1. The rim elements of the casing wall 16 and the upper closure member 13 constitute together with the annular groove 15 a rotatable but completely light-tight seal. A peripheral flange 17 which extends in axially parallel arrangement, about the lid 6, fits on to a correspondingly recessed rim about the opening 12*b* of the tank-completing base part 12.

The spiral 5 is mounted on a shaft 7 which bears film holding lugs 18 for fastening thereon the leading end of the film 4.

Figure 3:
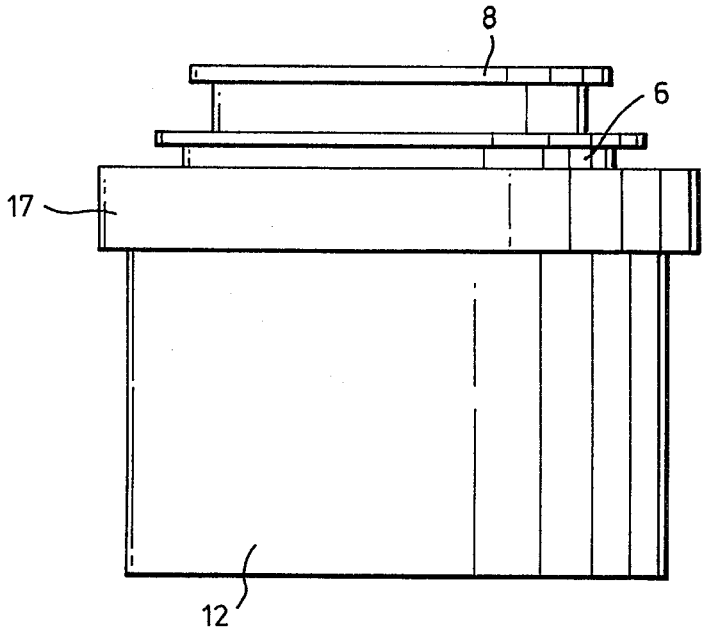
FIG. 3 is a lateral view of the assembled processing tank removed from the container.

The axial displacement of the tank-completing base member 12 to the left in FIG. 2 in the dark of the container interior and under conditions excluding the entry of light, leads to the engagement of the rim of the opening 12*b* with interference fit under the annular flange 17, thus completing the light-tightly closed tank which is shown in FIG. 3.

The tank-completing base member 12 can be made preferably from stainless steel, while the lid 6 and the lid cap 8 can be made of a more or less resilient material, preferably of an elastic synthetic resin material.

The lid cap 8 serves to close off a liquid entry passage 19 in the lid 6, through which, after removal of the lid cap 8, a developer or other processing liquid can be filled via a window 20 of the inwardly projecting lid collar 21 into the completed tank after the latter has been placed upright with its lid 6 on top, while there is no possibility that light might enter the tank interior. For a light-sealing disc 22, being mounted fixedly on the end of the spiral shaft 7 which is on the side of the lid 6, prevents such entry of light due to the fact that the disc 22, being firmly connected with the rim of the lid collar 21, is of considerably smaller diameter than the disc 22.

The spiral 5 shown in FIGS. 1 and 2 is of the internal winding type. In this case, the end of the film 4 is led to the center of the spiral 5 and attached to lugs 18 present on the central rod 7.

Thus, at the beginning of an operation of the device shown in the drawings, the lid 6 and the base member 12 are in their respective positions in the sidewall of the container 1 as shown in FIGS. 1 and 2; the closure member 13 is now removed from the container 1, a cassette 3 containing exposed film 4 is placed in the holding means 2 and the leading edge of the film 4 is led through a gap in the guillotine 11 to the central shaft 7 of the spiral 6 where it is attached to lugs 18 present on the shaft 7.

The container 1 is again closed by returning the closure member 13 to its closing position, and the film 4 is wound onto the spiral 5 by rotating the lid cap 8 from outside the container which lid cap 8 causes the lid 6, the shaft 7 and the discs 10 to rotate with it. When it is noticeable from the resistance exerted by the film length to further rotation of the lid that most of the length of film 4 has been wound on to the spiral 5, the guillotine 11 is actuated to cut off the film 4 close to the cassette exit, and the final portion of the film length is wound onto the spiral 5.

The tank-completing base member 12 is then urged into the container 1 with rotation and/or axial displacement until it engages the lid 6 with a light-tight interference fit. The lid closure member 13 can then be raised and the assembled processing tank as shown in FIG. 3 can be removed from the container. The film in this tank can then be processed in a conventional manner.

In order to ensure joint rotation of the lid 6, the disc 22 and the shaft 7 together with the light cap 8 when the latter is turned by hand outside the casing 1, engaging means have been provided which are well known and have been omitted from FIG. 2 for the sake of greater clarity.

We claim:

1. A combined film cassette unloading and film processing device which comprises a light-tight closable container comprising, in its interior, means for holding a film cassette to enable a piece of film of determined length to be withdrawn therefrom, together with a film cutting means; a lid member of a processing tank of the film-holding spiral type being rotatably but detachably mounted in a light-tight manner in one side of the container; a spiral being attached to the inner side of the said lid member and so located in the container that the film from a cassette can be wound thereon; and a tank-completing base member located on the opposite side of the container which base member together with the lid and the spiral form a processing tank of the spiral film holding type, the base member being so held in a light-tight manner that, when the film from the cassette has been wound onto the spiral and when the end of said film piece has been cut off from the cassette, the base member can be fitted on to said lid member whilst both are still connected to the container in a light-tight manner, whereupon the completed processing tank can be removed as a unit from the container as an entity once it has been assembled.

2. The combined device of claim 1, wherein said lid member comprises a rotatable seal by means of which said lid member is held in a side of said container.

3. The device of claim 1, wherein said tank-completing base member is rotatably or axially displaceable and is held in a side of the container by means of a circumferential seal.

4. The device according to claim 1, further comprising fitting means adapted for fitting said tank completing base member to said lid member.

5. The device of claim 4, wherein said fitting means is an interference fit.

* * * * *